US006004673A

United States Patent [19]

Nishijima

[11] Patent Number: 6,004,673

[45] Date of Patent: Dec. 21, 1999

[54] SPLITTABLE COMPOSITE FIBER

[75] Inventor: Masaru Nishijima, Shiga, Japan

[73] Assignee: Chisso Corporation, Osaka, Japan

[21] Appl. No.: 09/045,565

[22] Filed: Mar. 23, 1998

[30] Foreign Application Priority Data

Apr. 3, 1997 [JP] Japan ..... 9-101089

[51] Int. Cl.[6] ..... D02G 3/00

[52] U.S. Cl. ..... 428/373; 428/397; 428/398; 428/91; 428/96; 428/97; 428/374

[58] Field of Search ..... 428/373, 397, 428/398, 91, 96, 97, 374

[56] References Cited

U.S. PATENT DOCUMENTS

| | | | |
|---|---|---|---|
| 4,073,988 | 2/1978 | Nishida et al. | 428/91 |
| 4,233,355 | 11/1980 | Sato et al. | 428/224 |
| 4,381,335 | 4/1983 | Okamoto et al. | 428/373 |
| 4,814,032 | 3/1989 | Taniguchi et al. | 156/167 |
| 5,178,646 | 1/1993 | Barber, Jr. et al. | 51/298 |
| 5,240,983 | 8/1993 | Tabata et al. | 524/261 |
| 5,654,086 | 8/1997 | Nishijima et al. | 442/199 |
| 5,733,656 | 3/1998 | Iohara et al. | 428/397 |
| 5,759,926 | 6/1998 | Pike et al. | 442/333 |
| 5,770,307 | 6/1998 | Rackley et al. | 428/373 |

FOREIGN PATENT DOCUMENTS

| | | |
|---|---|---|
| 3-137222 | 6/1991 | Japan . |
| 5-321018 | 12/1993 | Japan . |
| 6-70954 | 3/1994 | Japan . |

*Primary Examiner*—Marion McCamish
*Assistant Examiner*—Arti Singh
*Attorney, Agent, or Firm*—McDermott, Will & Emery

[57] ABSTRACT

The present invention provides a splittable composite fiber having improved processability on carding and superior splitting property by a splittable composite fiber comprising at least two thermoplastic resin components, and having a structure wherein a part of at least one of the components projects from the surface of the fiber.

19 Claims, 4 Drawing Sheets

SPLITTABLE COMPOSITE FIBER

TECHNICAL FIELD

The present invention relates to a splittable composite fiber. In particular, the present invention relates to a splittable composite fiber that maintains favorable processability during carding and that has a highly excellent splitting property.

BACKGROUND ART

In recent years, woven and non-woven fabrics made of ultra-fine fibers have widely been used because of their high degree of softness, good touch, and excellent wiping property, as well as high strength in the case of non-woven fabrics. One commonly used method for fabricating non-woven fabrics from ultra-fine fibers is disclosed in Japanese Patent Publication No. 48-28005 (1973), in which a non-woven fabric is fabricated by integrating composite fibers each comprising at least two resin components that have poor compatibility with each other—known as splittable composite fibers—into a web through use of a dry or wet method, then splitting and entangling the fibers through the physical impact of a high pressure fluid or the like.

However, since such splittable composite fibers are required to be easily split by physical impact, thermoplastic resins having poor compatibility with each other are combined, resulting in the difficulty of carding when the web is formed through dry carding or the like, because static electricity is generated due to the formation of split portions during the process, and neps are produced due to the reduction of fiber fineness. If splitting is reduced, on the other hand, the difficulty of carding is improved, but the composite fibers will become difficult to split by physical impact, resulting in poor processability.

An object of the present invention is to solve the problems in processing prior art splittable composite fibers described above, and to provide a splittable composite fiber which can be easily split.

DISCLOSURE OF INVENTION

The inventors of the present invention conducted repeated examinations for solving the above problems and found that the above object was achieved when the cross-section of conventional splittable composite fibers was changed to a profiled cross-section having projections on the surface of the fiber, or to a profiled cross-section having indentations at a part of joined portions, in order to effectively impart physical impact such as hydraulic pressure onto the fiber without propagating the impact in a direction tangential to the fiber surface.

According to a first aspect of the present invention, there is provided a splittable composite fiber comprising at least two thermoplastic resin components, wherein the cross-sectional shape includes projections formed on the surface of the fiber by a part of at least one resin component constituting the fiber.

According to a second aspect of the present invention, there is provided a splittable composite fiber according to the first aspect, wherein the ratio of the circumferential length of the joined portion where at least two thermoplastic resin components come into contact with each other, L1, to the circumferential length of the portion where the thermoplastic resin components do not come into contact with each other and form the circumference, L2, is within the range represented by the following relation:

$$0.2 \leqq L1/L2$$

BRIEF DESCRIPTION OF DRAWINGS

FIG. 1-*b* is a conceptional diagram illustrating the impact of high-pressure fluid on a splittable composite fiber of the present invention.

Figure 1A:
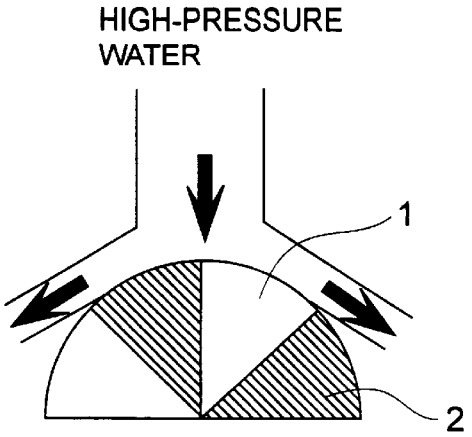
FIG. 1-*a* is a conceptional diagram illustrating the impact of high-pressure fluid on a conventional splittable composite fiber.

1: Component A
2: Component B
3: Projection
4: Indentation
L1(solid line): Circumferential length of a joined portion
L2 (broken line): Circumferential length of a projection on the cross-section of the fiber

PREFERRED EMBODIMENTS

The present invention will be described in detail below.

Thermoplastic resins constituting the splittable composite fiber of the present invention are of the same type as those used in ordinary composite fibers. Examples of such resins include polymers for general uses, including polyolefin resins such as polyethylene, polypropylene, and propylene-based α-olefin copolymers; polyamide resins such as nylon 6, nylon 66, and polyether blocked amide copolymers; and polyester resins such as polyethylene terephthalate, polybutylene terephthalate, polyethylene naphthalate, polyethylene terephthalate-isophthalate copolymers, and polyether-ester copolymers. Fluorinated resins such as polyvinylidene fluoride; polyethylene-vinyl alcohol copolymers; polyphenylene sulfide resins; and polyether-ether ketone resins can also be included in these examples.

The splittable composite fiber of the present invention is produced by combining at least two resin components having poor compatibility with each other among these thermoplastic resins.

The thermoplastic resins used in the splittable composite fiber of the present invention may be used singly, or two or more resins may be blended into a component. Although the number of components may be up to five, in consideration of manufacturing costs the number is preferably limited to three, and more preferably two. Each thermoplastic resin may contain additives that impart functions such as color forming, heat resistance, light resistance, heat storage, light storage, light emission, electrical conductivity, and hydrophilic or hydrophobic properties. These additives may be selected and combined as required by uses.

In the cross section of the splittable composite fiber of the present invention, two adjacent thermoplastic resin components form joined portions having indentations along a portion of the circumference of the fiber, and a part of at least one resin component forms projections on the fiber surface. Unlike ordinary splittable composite fibers having circular or oval cross-sections, the fiber of the present invention has pleat-like projections along the fiber surface, and the two thermoplastic resin components constituting the fiber are joined with each other at portions other than the ridges of the pleat-like projections. It is preferred, from the point of view of splitting, that the two resin components are joined at locations as near the bottoms of the pleat-like projections as possible, where physical impact for splitting the fiber works effectively.

FIGS. 2 through 9 show the cross-sectional shapes of example splittable composite fibers of the present invention. Examples shown in FIGS. 2 through 4 have cross-sections corresponding to the cross-sections of typical conventional splittable composite fibers shown in FIG. 10, but the ratios of two adjacent thermoplastic resin components 1 and 2 are changed, and the projecting degrees of projections 3 to the whole cross-section are varied.

Figure 5:
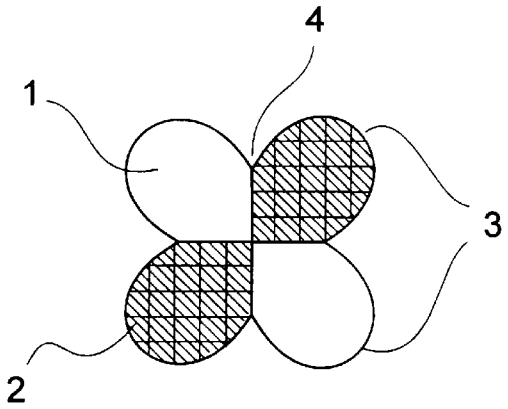
FIG. 5 is a cross-sectional view showing a splittable composite fiber of the present invention.
Figure 6:
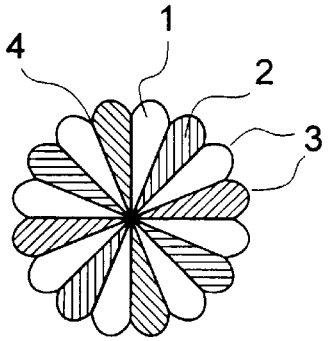
FIG. 6 is a cross-sectional view showing a splittable composite fiber of the present invention.
Figure 7:
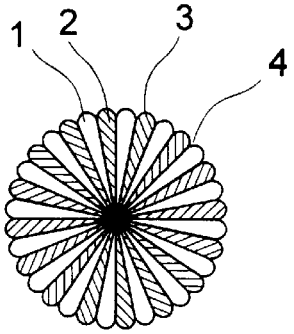
FIG. 7 is a cross-sectional view showing a splittable composite fiber of the present invention.
Figure 8:
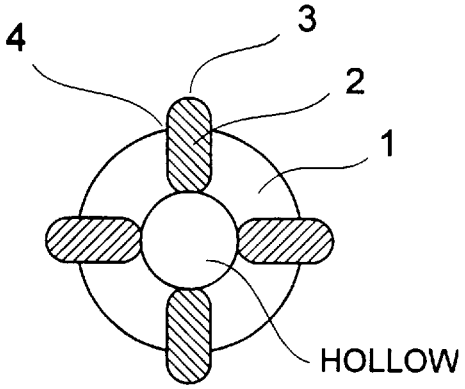
FIG. 8 is a cross-sectional view showing a splittable composite fiber of the present invention.
Figure 9:
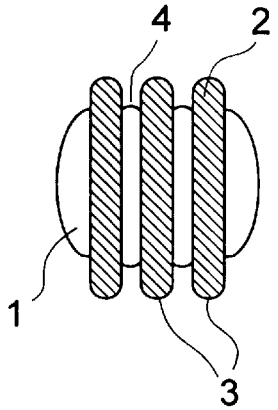
FIG. 9 is a cross-sectional view showing a splittable composite fiber of the present invention.
Figure 11:
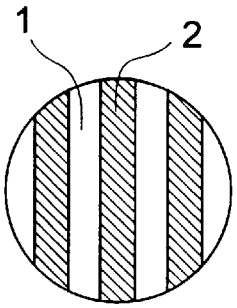
FIG.11 PRIOR ART
FIG. 11 is a cross-sectional view showing a conventional splittable composite fiber.

Examples of the splittable composite fiber of the present invention also include those with increased or decreased sections of the components shown in FIGS. 5 through 7; one with a hollow part formed in the center axis of the fiber as shown in FIG. 8; one with two components arranged in parallel as shown in FIG. 11; and one with sections of a component 2 projecting on the fiber surface as shown in FIG. 9.

However, the above examples should not be construed as limiting the cross-sectional shapes of the fibers of the present invention. The joined portions of the components constituting the splittable composite fiber are not required to reach the center of the fiber. Also, the center of the gravity of each component constituting the splittable composite fiber does not have to be identical. Therefore, various splittable composite fibers which are made eccentric and crimped three-dimensionally can be produced to meet the requirements of uses.

Figure 12:
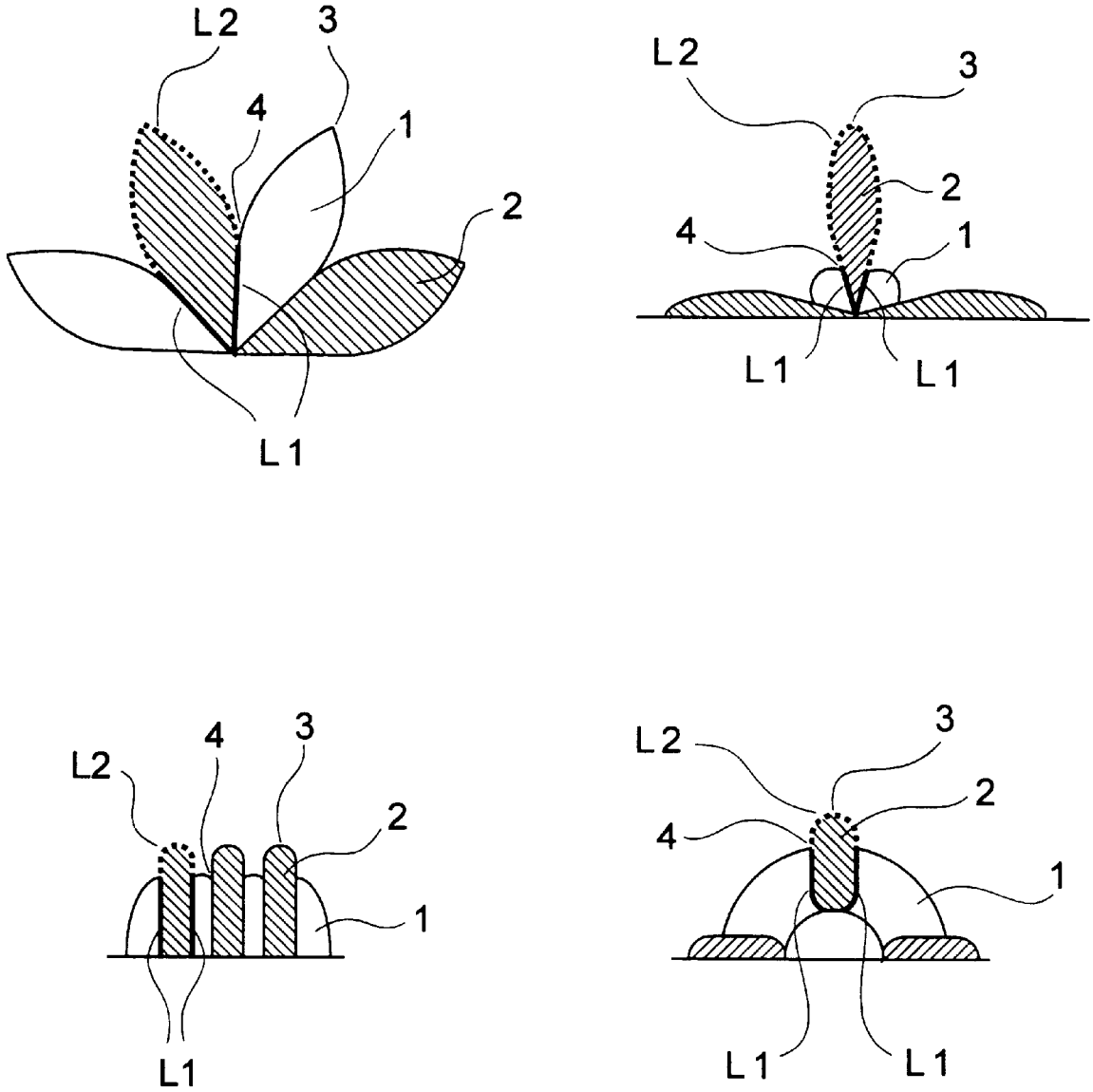
FIG. 12 shows cross-sectional views of various splittable composite fibers for illustrating the concept of the joined portion where two thermoplastic resin components come into contact with each other and the portion of projection where the thermoplastic resin components do not come into contact with each other.

In the splittable composite fiber of the present invention, the length of the joined portion where at least two thermoplastic resin components come into contact with each other (L1) and the length of projections where these resin components do not come into contact with each other (L2) are circumferential lengths shown in FIG. 12. As FIG. 12 shows, the circumferential length of the joined portions of a component forming a projection and the adjacent component (indicated by solid lines) is represented by L1 and the circumferential length of the portions that do not come into contact with each other (indicated by broken lines) is represented by L2. Therefore, the lengths of portions facing the space of the hollowed portion are neither L1s nor L2s.

In the splittable composite fiber of the present invention, the circumferential length ratio of L1 to L2 is preferably $0.2 \leqq L1/L2$, in consideration of the damage of fibers during both fiber manufacturing and non-woven fabric processing. If L1 is significantly smaller than L2, the fibers may be cut, or powder may be produced from broken fibers during processed before splitting, thus deteriorating the quality of resultant fibers. More preferably, $0.2 \leqq L1/L2 \leqq 10$. This is because the effect of increasing the splitting rate is diminished when L1/L2 exceeds a certain value.

The single yarn fineness of the splittable composite fiber of the present invention is not particularly limited so long as it is 0.5 denier or more, from the point of view of processability. If the single yarn fineness is less than 0.5 denier, neps may be produced or the spinning speed may be lowered during the formation of fiber aggregate in the processing of non-woven fabric, resulting in poor processability.

Although the number of sections of the components which can be split and the fineness of ultra-fine fibers after splitting are not particularly limited, the fineness of ultra-fine fibers after splitting is preferably 0.02 to 0.5 denier, and more preferably 0.02 to 0.3 denier so as to yield non-woven fabrics having excellent flexibility.

The splittable composite fiber of the present invention is easily split by physical impact such as high-pressure fluid; e.g., pressurized water or compressed air, needle punching, and wet beating in the same manner as widely used ordinary splittable composite fibers.

Ultra-fine non-woven fabrics made from splittable composite fibers preferably have a splitting percentage of 60 percent or higher, from the point of view of flexibility. Their splitting conditions and splitting percentage vary depending on water pressure, line speed, the number of steps, and the distance between water ejection nozzles and the web.

Figure 1B:
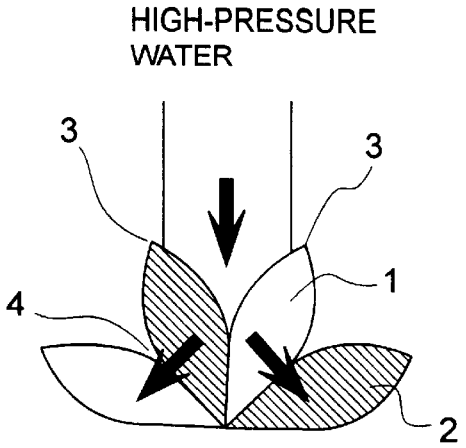
PRIOR ART FIG. 1B

Since conventional splittable composite fibers have round or oval cross-sections as shown in FIG. 1-*a*, the impact of the high-pressure fluid escapes along the fiber surface in tangential directions as indicated by solid arrows. Achievement of a splitting percentage of 60 percent or higher requires measures such as increasing water pressure, lowering line speed, or increasing the number of steps, making the improvement of processability difficult.

In the splittable composite fiber of the present invention, on the other hand, as shown in FIG. 1-*b*, indentations 4 are present along the circumference of the fiber where two thermoplastic resin components 1 and 2 join with each other, and projections 3 project from the fiber surface. Therefore, the high-pressure fluid indicated by solid arrows is retained in indentations 4 without escaping along the fiber surface, and the impact works effectively from the indentations 4 along the fiber surface causing a concentration of the energy of the high-pressure fluid at joined portions. For the same fiber fineness, since the splittable composite fiber of the present invention has a smaller interfacial area of components constituting the fiber than that of splittable composite fibers having round or oval cross-sections, the components can easily be split by a smaller impact force, resulting in improvement of processability such as an increase in processing line speed, a reduction in pressure, or a decrease in the number of steps.

With the splittable composite fiber of the present invention, since projected portions receive impact effectively and at this time stress is easily concentrated in interfacial portions between components constituting the fiber, the components can be split easily even in the case of long fibers having a large interfacial area in the axial direction.

Experiment

The present invention will be described in further detail with reference to examples; however, the present invention should not be construed as being limited thereto.

In the following examples, various physical properties of fibers and the performance of non-woven fabrics were evaluated through use of the following methods:

(1) Tenacity and elongation of yarn before splitting were measured in accordance with the method specified in Japanese Industrial Standards (JIS) L 1069. The tenacity (g/d) and elongation (%) were measured under conditions of a sample length of 20 mm and a stretching speed of 20 mm/min.

(2) The ratio of joined portions to projections on a cross-section (L1/L2):

A bundle of fibers was embedded in wax and cut with a microtome in a direction substantially perpendicular to the axis of the fibers to obtain a test piece. The test piece was observed through a microscope, the cross-sectional image obtained was processed by a computer, and the circumferential length of each portion on the cross-sectional image was measured and the ratio was calculated.

(3) Ease of carding was evaluated by visual observation, and ranked as follows:

○: Waste fibers or neps were produced to a very small extent.

Δ:Waste fibers or neps were produced to a small extent.

×: Waste fibers or neps were produced to a great extent, or the web was broken.

(4) Splitting percentage:

A bundle of fibers was embedded in wax and cut with a microtome in a direction substantially perpendicular to the axis of the fibers to obtain a test piece. The test piece was observed through a microscope, the cross-sectional image thus-obtained was processed by a computer, and the total cross-sectional area of ultra-fine fibers that had been split and the total cross-sectional area of the splittable composite fiber that had not been split were measured, and the percentage was calculated through use of the following equation.

$$\text{Splitting percentage } (\%)=\{A/(A+B)\}\times 100$$

where A: cross-sectional area of ultra-fine fibers that had been split

B: cross-sectional area of splittable composite fibers that had not been split (5) Feel was evaluated by the touch of ten panelists. The sample of Comparative Example 1 was used for comparison. The results were ranked as follows:

○: Evaluated as good by eight or more panelists.

Δ: Evaluated as good by five or more and fewer than eight panelists.

×: Evaluated as no good by four or more panelists.

(6) Overall evaluation was made based on ease of carding, feel, and splitting percentage, and was ranked as follows:

○: The object of the present invention is satisfied.

×: The sample is inadequate in achieving the object of the present invention.

The results of evaluations are shown in Table 1.

TABLE 1

Figure 2:
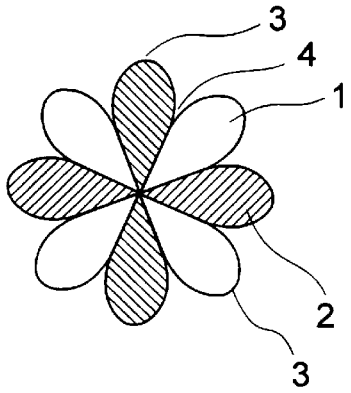
FIG. 2 is a cross-sectional view showing a splittable composite fiber of the present invention.
Figure 3:
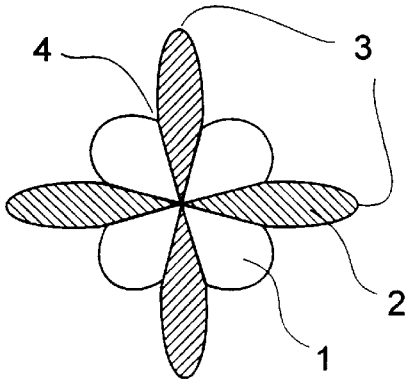
FIG. 3 is a cross-sectional view showing a splittable composite fiber of the present invention.
Figure 4:
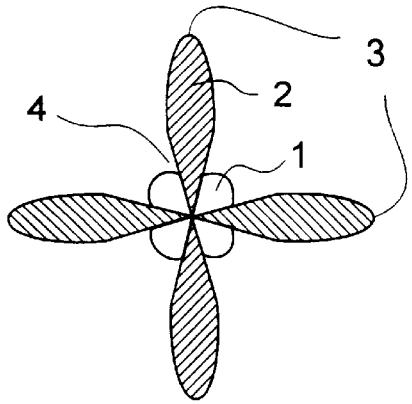
FIG. 4 is a cross-sectional view showing a splittable composite fiber of the present invention.

| | Cross-sectional shape | L1/L2 | Tenacity g/d | Elongation % | Ease of carding | Splitting percentage % | Feel | Overall evaluation |
|---|---|---|---|---|---|---|---|---|
| Example 1 | FIG. 2 | 1.18 | 3.5 | 65 | ○ | 90 | ○ | ○ |
| Example 2 | FIG. 3 | 1.00 | 3.5 | 64 | ○ | 78 | ○ | ○ |
| Example 3 | FIG. 4 | 0.25 | 3.0 | 48 | Δ | 95 | ○ | ○ |
| Example 4 | FIG. 5 | 0.43 | 3.3 | 70 | ○ | 94 | ○ | ○ |
| Example 5 | FIG. 6 | 3.82 | 3.8 | 45 | ○ | 75 | ○ | ○ |
| Example 6 | FIG. 7 | 9.07 | 3.9 | 42 | ○ | 68 | ○ | ○ |
| Example 7 | FIG. 8 | 1.43 | 3.0 | 60 | ○ | 88 | ○ | ○ |
| Example 8 | FIG. 9 | 1.25 | 3.5 | 65 | ○ | 75 | Δ | ○ |
| Example 9 | FIG. 5 | 0.43 | 1.5 | 350 | — | 70 | Δ | ○ |
| Comp. Ex. 1 | FIG. 10 | — | 4.0 | 43 | ○ | 45 | — | X |
| Comp. Ex. 2 | FIG. 11 | — | 3.5 | 52 | ○ | 30 | X | X |
| Comp. Ex. 3 | FIG. 10 | — | 1.8 | 428 | — | 0 | X | X |

EXAMPLES 1, 2, 3, 4, 5, 6, 7, AND 8

Splittable composite fibers comprising polypropylene having an MFR of 30 (g/10 min. at 230° C.) as the first component and high-density polyethylene having an MFR of 25 (g/10 min. at 190° C.) as the second component were spun through use of spinerets for splittable composite fibers to yield respective cross-sections shown in FIGS. 2, 3, 4, 5, 6, 7, 8, and 9.

These splittable composite fibers were stretched by hot rollers, crimped to have approximately 14 crimps per inch through use of a crimper, coated by 0.3 percent by weight of the potassium salt of alkyl phosphate, and cut to obtain staple fibers of a single yarn fineness of 3.0 denier and a length of 51 mm.

Webs were formed from the resultant staple fibers by carding, and the webs were processed into non-woven fabrics on a conveyor traveling at a speed of 5 m/min through sequential application of water pressure of 40, 60, and 60 kg/cm$^2$. The results of evaluation are shown in Table 1.

EXAMPLE 9

Splittable composite fibers comprising polypropylene having an MFR of 40 (g/10 min. at 230° C.) as the first component and linear low-density polyethylene having an MFR of 50 (g/10 min. at 190° C.) as the second component were spun through use of a spineret for splittable composite fibers to yield a cross-section shown in FIG. 5. Immediately after spinning, these fibers were drawn by high-speed air, and laminated on a conveyor net.

The resultant laminate was processed into a non-woven fabric on a conveyor traveling at a speed of 5 m/min through sequential application of high-pressure water of 40, 60, and 60 kg/cm$^2$. The results of evaluation are shown in Table 1.

COMPARATIVE EXAMPLES 1 AND 2

Figure 10:
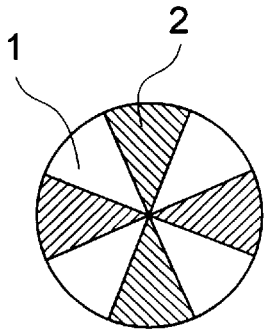
FIG.10 PRIOR ART
FIG. 10 is a cross-sectional view showing a conventional splittable composite fiber.

Splittable composite fibers comprising polypropylene having an MFR of 30 (g/10 min. at 230° C.) as the first component and high-density polyethylene having an MFR of 25 (g/10 min. at 190° C.) as the second component were spun through use of spinerets for splittable composite fibers to yield respective cross-sections shown in FIGS. 10 and 11.

These splittable composite fibers were stretched, crimped to have approximately 14 crimps per inch through use of a crimper, coated by 0.3 percent by weight of the potassium salt of alkyl phosphate, and cut to obtain staple fibers having a single yarn fineness of 3.0 denier and a length of 51 mm.

Webs were formed from the resultant staple fibers by carding, and the webs were processed into non-woven fabrics on a conveyor traveling at a speed of 5 m/min through sequential application of high-pressure water of 40, 60, and 60 kg/cm$^2$. The results of evaluation are shown in Table 1.

COMPARATIVE EXAMPLE 3

Splittable composite fibers comprising polypropylene having an MFR of 40 (g/10 min. at 230° C.) as the first component and linear low-density polyethylene having an MFR of 50 (g/10 min. at 190° C.) as the second component were spun through use of a spineret for splittable composite fibers to yield a cross-section shown in FIG. 10. Immediately after spinning, these fibers were drawn by high-speed air, and laminated on a conveyor net.

The resultant laminate was processed into a non-woven fabric on a conveyor traveling at a speed of 5 m/min through sequential application of high-pressure water of 40, 60, and 60 kg/cm$^2$. The results of evaluation are shown in Table 1.

Industrial Applicability

Since the splittable composite fiber of the present invention has special profiled cross-sectional shapes, physical impact such as high-pressure fluid can be effectively imparted to the fiber without allowing the impact to escape along the fiber surface in tangential directions, and the splitting property can be improved without lowering processability.

Thus, ultra-fine fiber non-woven fabrics produced by splitting the splittable composite fiber of the present invention can be used in medical and industrial wiping cloth, medical and industrial filters, masks, surgical gowns, packaging cloth, the surface material for hygienic products, reinforcing fibers for building structures, and membrane for transporting liquids.

I claim:

1. A splittable composite fiber comprising at least two thermoplastic resin components, wherein the profiled cross-sectional shape of the fiber has discrete and separate projections formed on the surface of the fiber and wherein the projections form acute angled edges which meet at or near the center of the fiber and wherein each projection comprises one thermoplastic resin component and adjacent projections define a space therebetween.

2. A splittable composite fiber according to claim 1, wherein the spaces between adjacent projections have a dimension to receive a high pressure fluid which causes splitting of the projections.

3. A splittable composite fiber according to claim 1, wherein the projections have a ratio given by the following relation:

$$0.2 \leqq L1/L2 \leqq 10;$$

wherein L1 represents the circumferential length of the joined portion where the at least two thermoplastic resin components come in contact with each other and L2 represent the circumferential length of the portion where the at least two thermoplastic resin components do not come in contact with each other.

4. A splittable composite fiber according to claim 1, wherein each thermoplastic resin component forms a projection on the surface of the fiber.

5. A splittable composite fiber according to claim 1, wherein the thermoplastic resin components are selected from the group consisting of polyolefins, polyamides, polyether blocked amide copolymers, polyesters, fluorinated resins, polyethylene-vinyl alcohol copolymers, polyphenylene sulfide resins and polyether-ether ketone resins.

6. A splittable composite fiber according to claim 1, wherein the at least two thermoplastic resins comprise polypropylene as the first component and polyethylene as the second component.

7. A splittable composite fiber according to claim 1, wherein the splittable composite fiber has a splitting percentage of 60 percent or higher.

8. A method of forming ultra-fine fibers, the method comprising applying a high-pressure fluid between the projections of the splittable composite fiber of claim 1 splitting the composite fiber into ultra-fine fibers.

9. A method of forming ultra-fine fibers according to claim 8, comprising splitting the projections to ultra-fine fibers having 0.02 to 0.5 denier.

10. A method of forming ultra-fine fibers according to claim 8, comprising applying pressurized water or compressed air as the high-pressure fluid.

11. A method of forming ultra-fine fibers according to claim 8, comprising achieving a splitting percentage of 60 percent or higher.

12. A splittable composite fiber comprising at least two thermoplastic resin components, wherein at least one resin component forms discrete and separate projections on a surface of the fiber and (a) wherein the at least one resin component is arranged in essentially flat spaced, side-by-side layers and wherein the at least one resin component has opposed ends that project from the surface of the fiber, or (b) the fiber has a hollow center.

13. A splittable composite fiber according to claim 12, wherein the projections have a ratio given by the following relation:

$$0.2 \leqq L1/L2 \leqq 10;$$

wherein L1 represents the circumferential length of the joined portion where the at least two thermoplastic resin components come in contact with each other and L2 represent the circumferential length of the portion where the at least two thermoplastic resin components do not come in contact with each other.

14. A splittable composite fiber according to claim 12, wherein the thermoplastic resin components are selected from the group consisting of polyolefins, polyamides, polyether blocked amide copolymers, polyesters, fluorinated resins, polyethylene-vinyl alcohol copolymers, polyphenylene sulfide resins and polyether-ether ketone resins.

15. A splittable composite fiber according to claim 12, wherein the at least two thermoplastic resins comprise polypropylene as the first component and polyethylene as the second component.

16. A splittable composite fiber according to claim 12, wherein the splittable composite fiber has a splitting percentage of 60 percent or higher.

17. A method of forming ultra-fine fibers, the method comprising applying a high-pressure fluid between the projections of the splittable composite fiber of claim 12 splitting the composite fiber into ultra-fine fibers.

18. A method of forming ultra-fine fibers according to claim 17, comprising splitting the projections to ultra-fine fibers having 0.02 to 0.5 denier.

19. A method of forming ultra-fine fibers according to claim 17, comprising applying pressurized water or compressed air as the high-pressure fluid.

* * * * *